United States Patent [19]

Banner

[11] Patent Number: 4,781,346

[45] Date of Patent: Nov. 1, 1988

[54] CLIMBING AIDS

[76] Inventor: Hugh I. Banner, Fron Hywel, Llanrug, Caernarfon, Gwynedd, LL55 3BD, Wales

[21] Appl. No.: 84,832

[22] Filed: Aug. 13, 1987

[30] Foreign Application Priority Data

Aug. 13, 1986 [GB] United Kingdom ..... 8619672
Sep. 26, 1986 [GB] United Kingdom ..... 8623206

[51] Int. Cl.[4] ..... A47G 29/00
[52] U.S. Cl. ..... 248/1 R
[58] Field of Search ..... 248/1, 317; 182/3, 5; 294/95, 97

[56] References Cited

U.S. PATENT DOCUMENTS 4,184,657 1/1980 Jardine ..... 248/1
4,565,342 1/1986 Grow ..... 248/1
4,575,032 3/1986 Taylor ..... 248/1
4,643,377 2/1987 Christianson ..... 248/1
4,643,378 2/1987 Guthrie et al. ..... 248/1
4,645,149 2/1987 Cowl ..... 248/1

FOREIGN PATENT DOCUMENTS 2175219 5/1986 United Kingdom .

*Primary Examiner*—Alvin C. Chin-Shue
*Attorney, Agent, or Firm*—Oblon, Fisher, Spivak, McClelland & Maier

[57] ABSTRACT

There is disclosed a climbing aid comprising at least two cam members pivotally mounted on a spindle, one of the cam members pivotting in an opposite direction from the other, resilient means urging the cam members to a normal in use open position, a member attached to the spindle and to which a rope may be attached, and means for pivoting the cam members against the action of the resilient means into a closed position comprising flexible wires extending from the cam members through an aperture in said member attached to said spindle to connect with otherwise free manually operable means for pulling said wires.

7 Claims, 2 Drawing Sheets

CLIMBING AIDS

This invention concerns climbing aids and, in particular, anchor devices for securement in gaps, openings and the like in rock faces.

Various anchor devices have been proposed involving the use of cam members that can be forced into a gap in a rock face and then pivotted to prevent withdrawal. Some such devices include means for pivotting the cams so that they can be easily inserted into and removed from a gap in a rock face.

It is with this type of climbing aid that the present invention is mainly concerned and the object of the invention is to provide an improved climbing aid.

According to the invention there is provided a climbing aid comprising at least two cam members pivotally mounted on a spindle, one of the cam members pivotting in an opposite direction from the other, resilient means urging the cam members to a normal in use open position, a member attached to the spindle and to which a rope may be attached, and means for pivotting the cam members against the action of the resilient means into a closed position comprising flexible wires extending from the cam members through an aperture in said member attached to said spindle to connect with otherwise free manually operable means for pulling said wires.

By open position is meant that in which the cams are extended generally outwardly from their pivot point and by the closed position is meant that in which the cams are pivotted through approximately 90° towards the attachment member, whereby the climbing aid can be inserted into a gap or the like in a rock face.

The manually operable means may comprise a bar extending generally parallel with said spindle or a pull ring.

There may be three cam members, the central of which pivots in the opposite direction from the outer ones.

There may be two pairs of cam members, the inner of each pair pivotting in the same direction and oppositely to the outer of each pair.

The member attached to the spindle may be flexible and may comprise a U-shaped loop of cable whose limbs are spaced by transverse bars one of which has said aperture therein to locate said wires.

The means for urging the cam members to their open position may comprise for each cam a spring attached at one of its ends to the cam member and at the other of its ends to a point fixed relative to the spindle.

There may be means on each cam member that abut and act against each other to prevent the cams from pivotting away from one another beyond their open position.

To use the climbing aid of the invention the ring is pulled along or in the direction of the attachment member to pivot the cams to their closed position so that the aid can be inserted into an opening or gap in a rock face. (Insertion of the aid may also be achieved by pushing the aid into the opening so that the sides of the opening cause the cams to pivot.) The ring is then released so that the cams return to their open position.

To remove the climbing aid from the gap or opening the ring is pulled in order to pivot the cams into their closed position.

Having a flexible attachment member to attach a rope to allows the climbing aid to cope with sudden movements and so make it less likely to be jerked out of its location. Furthermore, in a horizontal gap, whereas a rigid support member is subject to a bending stress that may cause the member to break, a flexible member will bend naturally with the pull of a rope and so not be liable to break.

Four cam climbing aids are preferred as they tend to locate more securely in gaps or openings in a rock face.

The invention will be further apparent from the following description, with reference to the several figures of the accompanying drawings, which show, by way of example only, two forms of climbing aid embodying the invention.

Figure 1:
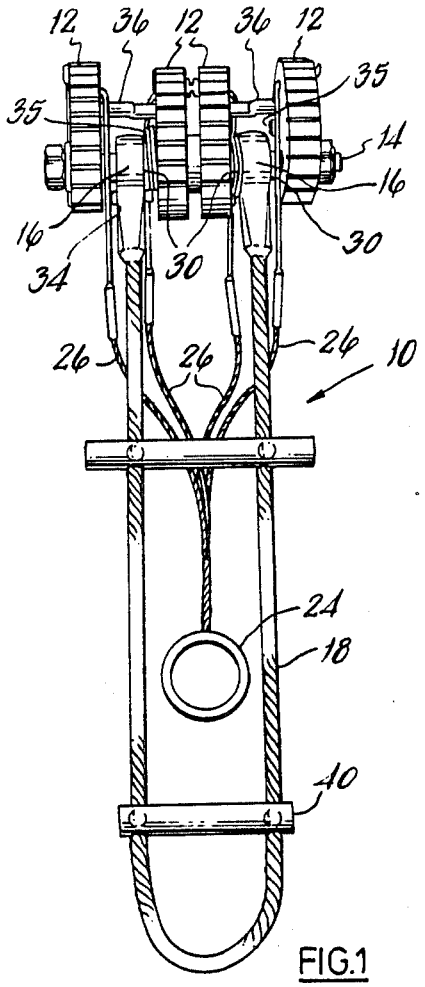
FIG. 1 is a front view of a first form of climbing aid.
Figure 2:
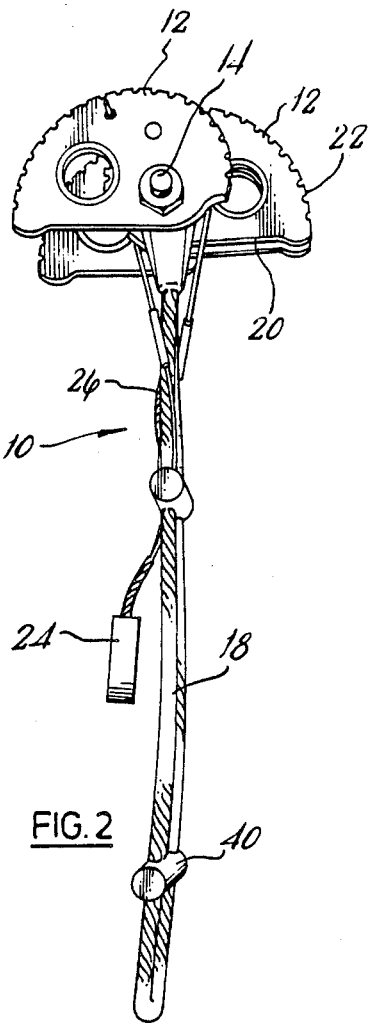
FIG. 2 is a side view of the climbing aid of FIG. 1.

Referring to FIGS. 1 and 2 of the drawings, a climbing aid 10 comprises two pairs of cams 12 pivotablly mounted on a spindle 14. The cams 12 of each pair are separated by rings 16 on the spindle to which ends of a U-shaped wire member 18 are fastened.

The cams 12 have a generally straight bottom surface 20 and an eccentrically curved upper surface 22. The cams are of the constant angle type. Each cam is connected to a pull ring 24 by a wire 26 whereby pulling the ring 24 away from the cams pulls them into their closed position.

Each of the cams 12 is urged into its open position by means of a coil spring 30 that has one of its end anchored on a spigot 34 on one side of a ring 16 and the other on a spigot 35 of the cam itself.

To ensure that the ring 24 pulls the wires 26 generally in the direction of the U-shaped member 18 the wires are passed through a bar 38 fixed on the member 18.

The cams are arranged in two pairs with those of each pair facing oppositely. The outer of each pair of cams face the same way as each other. To prevent the cams pivotting beyond their open position, i.e. oppositely to their closed position, each cam has a spigot 36 positioned to act against a spigot 36 of the other cam of its pair if a force is applied to pivot the cams in that direction.

Across the flexible member, near its U-bend is another fixed bar 40. The loop so formed serves as attachment position for a rope or rope connector.

In use the pull ring is used to pivot the cams into the closed position so that the climbing aid can be inserted into a gap or opening on a rock face. The aid is anchored therein by releasing the pull ring 24 to allow the cams to pivot to their open position. It is necessary to pull the ring 24 again to remove the aid from the gap or opening.

It will be appreciated that it is not intended to limit the invention to the above example only, many variations, such as might readily occur to one skilled in the art, being possible, without departing from the scope thereof as defined by the appended claims.

Figure 3:
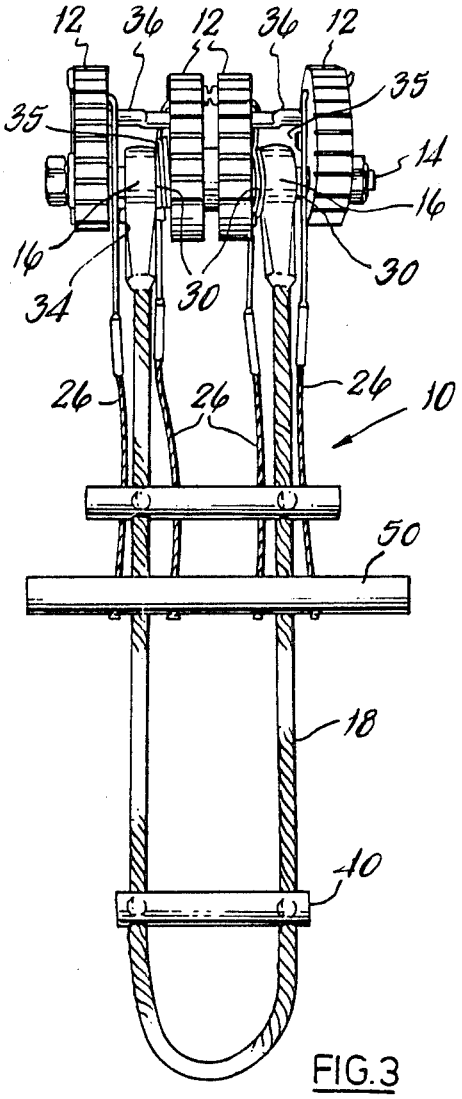
FIG. 3 is a front view of a second form of climbing aid.

Thus, for example, as shown in FIG. 3 the pull ring 24 may be replaced by a transverse bar 50 extending in a direction generally parallel with that of the spindle 14.

It will be understood that climbing aids having cam members whose bottom surfaces are of different lengths may be provided suitable for anchoring in crevices or gaps of different widths.

Again the arrangement of cam members may be different. When there are four cam members they may all be inside the limbs of the U-shaped loop. When there are three cam members they may all be inside or the centrally one only may be inside the limbs of the U-shaped loop.

I claim:

1. A climbing aid comprising at least two can members pivotally mounted on a spindle, one of the cam members pivoting in an opposite direction from the other, resilient means urging the cam members to a normal in use open position, a flexible member attached to the spindle and to which a rope may be attached and comprising a U-shaped loop of cable whose limbs are spaced by said spindle and at least one transverse bar spaced from said spindle, said limbs extending through spaced apertures in said transverse bar and secured therein, and means for pivoting the cam members against the action of the resilient means into a closed position comprising flexible wires extending from the cam members through aperture means in said transverse bar to connect with freely movable manually operable means for pulling said wires.

2. A climbing aid according to claim 1 wherein said manually operable means comprises a bar with at least one of said aperture means receiving at least some of said wires inside said loop extending generally parallel with said spindle.

3. A climbing aid according to claim 1 wherein said manually operable means comprises a pull ring.

4. A climbing aid according to claim 1 wherein there are two pairs of cam members, the inner of each pair pivoting in the same direction and oppositely to the outer of each pair.

5. A climbing aid according to claim 1 wherein said means for urging the cam members to their open position comprises for each cam a spring attached at one of its ends to the cam member and at the other of its ends to a point fixed relative to the spindle.

6. A climbing aid according to claim 1 including means on each cam member that abut and act against each other to prevent the cams from pivoting away from one another beyond their open position.

7. A climbing aid according to claim 6 wherein said means on each cam member comprises a spigot.

* * * * *